US011523686B1

(12) United States Patent
Liu et al.

(10) Patent No.: US 11,523,686 B1
(45) Date of Patent: Dec. 13, 2022

(54) FOLDABLE SHELF AND COMBINED SHELF THEREOF

(71) Applicant: GUANGDONG WIREKING HOUSEWARES & HARDWARE CO., LTD, Foshan (CN)

(72) Inventors: Nengwen Liu, Foshan (CN); Feifei Li, Foshan (CN); Yongkang Huo, Foshan (CN)

(73) Assignee: GUANGDONG WIREKING HOUSEWARES & HARDWARE CO., LTD, Foshan (CN)

( * ) Notice: Subject to any disclaimer, the term of this patent is extended or adjusted under 35 U.S.C. 154(b) by 0 days.

(21) Appl. No.: 17/396,757

(22) Filed: Aug. 8, 2021

(30) Foreign Application Priority Data

Jun. 11, 2021 (CN) ..... 202121320094.2

(51) Int. Cl.

| | |
|---|---|
| ***A47B 47/00*** | (2006.01) |
| ***A47B 43/00*** | (2006.01) |
| ***A47F 5/10*** | (2006.01) |
| ***A47B 96/02*** | (2006.01) |
| *A47B 96/06* | (2006.01) |

(52) U.S. Cl.
CPC ..... *A47B 43/00* (2013.01); *A47B 47/0058* (2013.01); *A47B 47/0083* (2013.01); *A47B 96/021* (2013.01); *A47F 5/10* (2013.01); *A47B 96/06* (2013.01)

(58) Field of Classification Search
CPC ..... A47B 43/00; A47B 96/06; A47B 96/021; A47B 47/0083; A47B 47/0058; A47B 47/045; A47B 87/0207; A47B 2220/0072; A47B 31/04; A47F 5/10
See application file for complete search history.

(56) References Cited

U.S. PATENT DOCUMENTS

| | | | | | |
|---|---|---|---|---|---|
| 436,482 | A * | 9/1890 | Killinger | A47B 43/04 | 190/14 |
| 907,032 | A * | 12/1908 | Gohen | A47B 43/04 | 312/198 |
| 2,226,570 | A * | 12/1940 | McCaw | A47B 43/00 | 211/189 |
| 2,748,955 | A * | 6/1956 | Anselmo | A47B 43/00 | 403/292 |
| 6,644,484 | B1 * | 11/2003 | Sardis | A47F 5/137 | 211/189 |
| 8,522,987 | B2 * | 9/2013 | Lim | A47B 96/021 | 211/189 |
| D724,357 | S * | 3/2015 | Lim | A47B 96/021 | D6/675.1 |

(Continued)

*Primary Examiner* — Kimberley S Wright

(57) ABSTRACT

An foldable shelf includes: a foldable support body, where the support body can be switched between a folded state and an unfolded state; several layer plates, where the several layer plates fit with the support body to form a storage space in the unfolded state and reduce a volume of the foldable shelf in the folded state; and a fixing mechanism for securing the layer plates to the support body, where the fixing mechanism includes: a first fastener, where an outer surface of the first fastener is provided with at least one protrusion; and a second fastener, where the second fastener is provided with a groove for accommodating the first fastener; where a side wall of the groove is provided with a through hole matching the protrusion.

15 Claims, 8 Drawing Sheets

(56) References Cited

U.S. PATENT DOCUMENTS 9,079,597 B2 * 7/2015 Gonzalez ..... A47F 5/10
9,226,574 B1 * 1/2016 Chen ..... A47B 96/07
9,247,809 B1 * 2/2016 Hsu ..... A47B 47/0083
9,282,820 B2 * 3/2016 Lo ..... A47B 87/0207
9,833,066 B2 * 12/2017 Hsu ..... A47B 96/06
10,165,855 B2 * 1/2019 Lim ..... A47B 96/021
10,398,224 B2 * 9/2019 Hsu ..... A47B 47/0058
10,485,337 B2 * 11/2019 Lim ..... A47B 47/0058
10,667,604 B2 * 6/2020 Hsu ..... A47B 47/0083
10,750,858 B1 * 8/2020 Barre ..... A47B 45/00
10,806,252 B2 * 10/2020 Lim ..... A47F 5/10
11,013,318 B2 * 5/2021 Hsu ..... A47B 47/0058
11,116,313 B2 * 9/2021 Leung ..... A47B 43/00
11,172,759 B2 * 11/2021 Liu ..... A47B 47/028
2006/0157435 A1 * 7/2006 Oberhaus ..... A47F 5/01
211/187
2011/0068072 A1 * 3/2011 Zhu ..... A47B 31/04
211/149
2011/0240571 A1 * 10/2011 Ho ..... A47B 96/02
211/13.1
2011/0290750 A1 * 12/2011 Lim ..... A47B 47/00
211/153
2013/0306585 A1 * 11/2013 Lim ..... A47B 47/047
211/186
2014/0190918 A1 * 7/2014 Lim ..... A47B 47/047
211/186
2014/0353271 A1 * 12/2014 Kruse ..... A47F 5/01
211/188
2015/0014263 A1 * 1/2015 Lo ..... A47B 87/0207
211/182
2016/0206091 A1 * 7/2016 Hsu ..... A47B 96/06
2018/0084905 A1 * 3/2018 Hsu ..... A47B 47/0058
2019/0380485 A1 * 12/2019 Hsu ..... A47B 47/0083
2020/0405050 A1 * 12/2020 Liu ..... A47B 43/00
2021/0161290 A1 * 6/2021 Leung ..... A47F 5/10
2021/0267363 A1 * 9/2021 Hsu ..... A47B 47/0083
2021/0378398 A1 * 12/2021 Doherty ..... A47B 43/00

* cited by examiner

FOLDABLE SHELF AND COMBINED SHELF THEREOF

TECHNICAL FIELD

The present disclosure relates to the technical field of storage containers, and in particularly, relates to a foldable shelf and a combined shelf thereof.

BACKGROUND

A foldable shelf is an apparatus widely used in daily life. The foldable shelf can usually be switched between an unfolded state and a folded state, so that it can be folded and stored and occupies a small space when not in use, and forms a storage space for storing or placing one or more articles in the unfolded state.

Traditional shelves use folding mechanisms in many forms to implement switching between the unfolded and folded states. However, the folding mechanisms usually cannot provide enough support strength to maintain a stable connection between different shelf components during switching from the folded state to the unfolded state. As a result, the foldable shelves cannot bear larger weights, limiting the storage of articles to some extent.

Some connection methods for improving strength are further adopted. However, these connection methods require the use of additional components or other tools (such as a screwdriver) to implement installation and fixation, and are inconvenient to daily use.

Therefore, it is desired to provide a foldable shelf with an appropriate structure that can prevent one or more of the above-mentioned disadvantages.

SUMMARY

According to one aspect, the present disclosure provides a foldable shelf. The foldable shelf includes:

a foldable support body, where the support body is capable of being switched between a folded state and an unfolded state;

several layer plates, where the several layer plates fit with the support body to form a storage space in the unfolded state and reduce a volume of the foldable shelf in the folded state;

and a fixing mechanism for securing the layer plates to the support body, where the fixing mechanism includes:

a first fastener, where an outer surface of the first fastener is provided with at least one protrusion; and a second fastener, where the second fastener is provided with a groove for accommodating the first fastener; where a side wall of the groove is provided with a through hole matching the protrusion.

According to another aspect, the present disclosure further provides a combined shelf. The combined shelf includes at least one foldable shelf and a lap joint support, where the lap joint support is detachably connected to the foldable shelf and is in lap joint with one foldable shelf or between a plurality of foldable shelves;

the foldable shelf includes: a foldable support body, where the support body is capable of being switched between a folded state and an unfolded state;

several layer plates, where the several layer plates fit with the support body to form a storage space in the unfolded state and reduce a volume of the foldable shelf in the folded state;

and a fixing mechanism for securing the layer plates to the support body, where the fixing mechanism includes:

a first fastener, where an outer surface of the first fastener is provided with at least one protrusion; and a second fastener, where the second fastener is provided with a groove for accommodating the first fastener; where a side wall of the groove is provided with a through hole matching the protrusion.

The foldable shelf according to the embodiments of the present disclosure provides a buckle type fixing apparatus, so that the layer plates can be simply connected to the support body, and a connection strength between the layer plates and the support body is improved. Moreover, the buckle type fixing apparatus is simple and easy to use, does not need additional tools and independent connecting structures, and does not cause inconvenience to daily use.

BRIEF DESCRIPTION OF DRAWINGS

To explain the technical solutions of the embodiments of the present disclosure more clearly, the following will briefly describe the accompanying drawings required in the embodiments of the present disclosure. Apparently, the accompanying drawings in the following description show only some embodiments of the present disclosure, and a person of ordinary skill in the art may still derive other accompanying drawings from the accompanying drawings without creative efforts.

DETAILED DESCRIPTION

To facilitate the understanding of the present disclosure, the present disclosure will be described in more detail with reference to the accompanying drawings and specific embodiments. It should be noted that when an element is said to be "fixed" to another element, it may be directly fixed to another element, or one or more intermediate elements may be present therebetween. When an element is said to be "connected" to another element, it may be directly connected to another element, or one or more intermediate elements may be present therebetween. The terms "vertical", "horizontal", "left", "right" and similar expressions used in the specification are for the purpose of illustration only.

Unless otherwise defined, all technical and scientific terms used in the specification have the same meanings as those usually understood by a person skilled in the art of the present disclosure. Terms used in the specification in the present disclosure are only for the purpose of describing specific embodiments, and are not intended to limit the present disclosure. As used in the specification, the term "and/or" includes all possible combinations of one or more related listed items.

Figure 1:
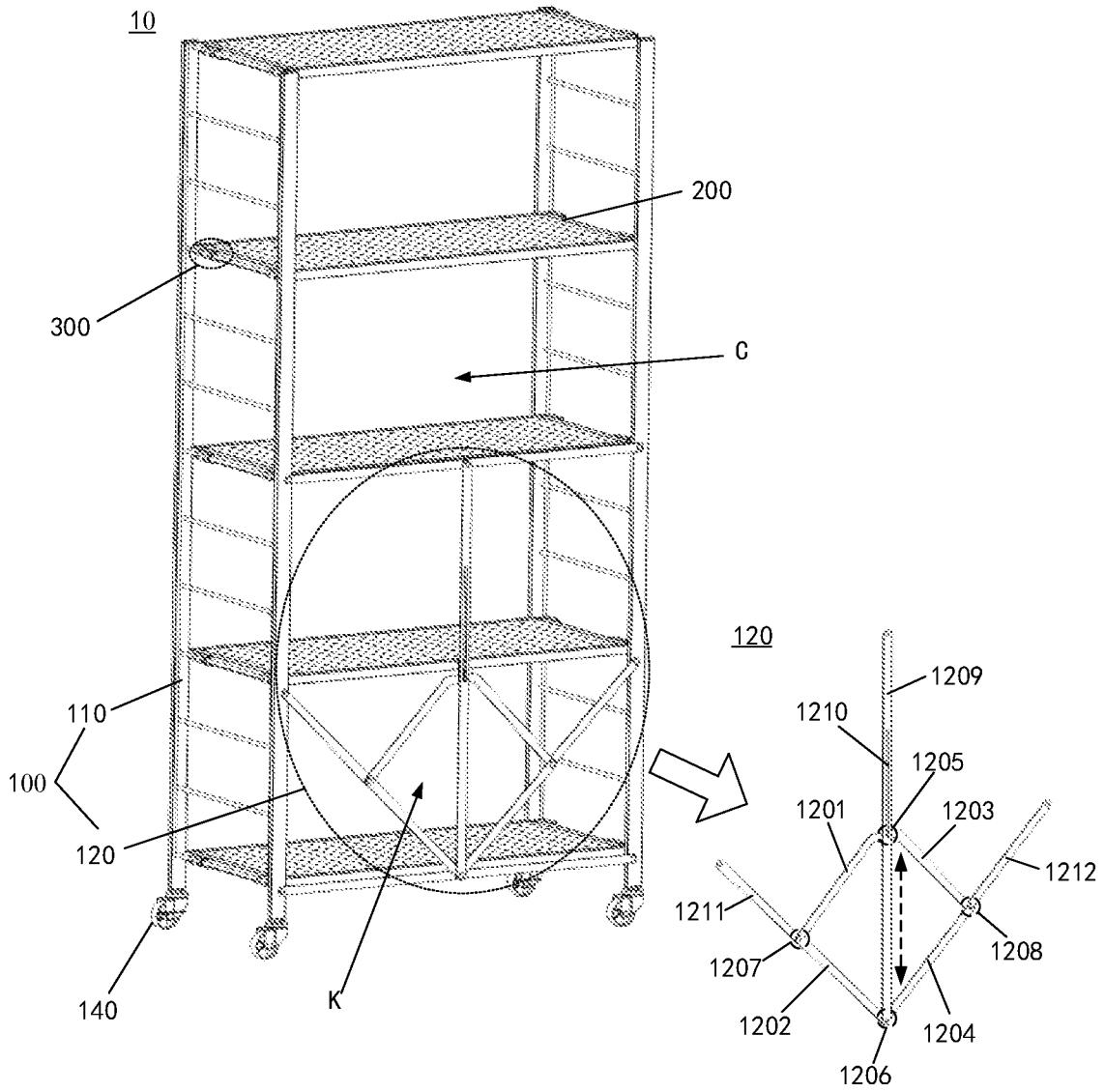
FIG. 1 is a schematic structural diagram illustrating a foldable shelf in an unfolded state according to an embodiment of the present disclosure.
Figure 2:
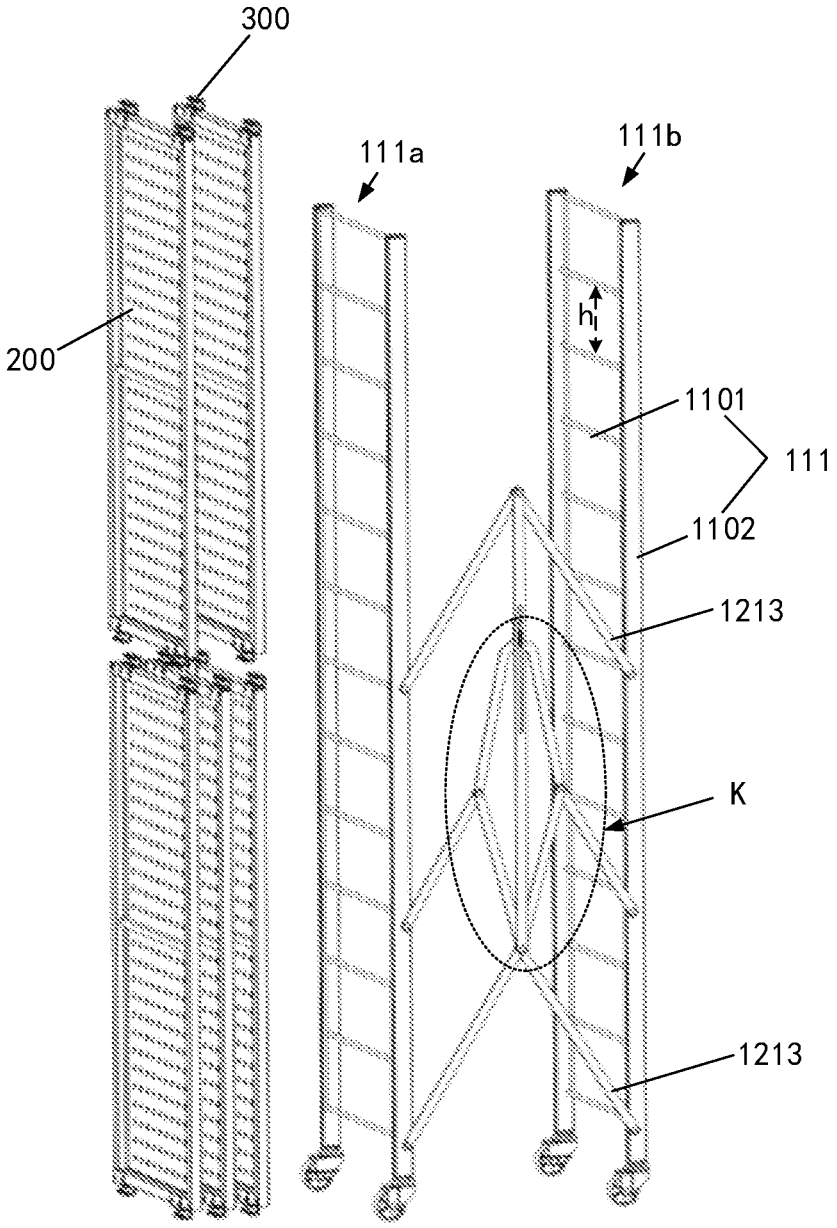
FIG. 2 is a schematic structural diagram illustrating a foldable shelf in a folded state according to an embodiment of the present disclosure.

FIG. 1 is a schematic structural diagram illustrating a foldable shelf in an unfolded state according to an embodiment of the present disclosure. FIG. 2 is a schematic structural diagram illustrating a foldable shelf in a folded state according to an embodiment of the present disclosure.

As shown in FIG. 1 and FIG. 2, the foldable shelf 10 includes a foldable support body 100, several layer plates 200, and a fixing mechanism 300.

The support body 100 is a main structure of the foldable shelf, and may be roughly composed of a support structure 110 providing a support frame and a folding mechanism 120 guiding the support structure to switch between a folded state and an unfolded state.

In some embodiments, the support structure 110 may include a group of paired side supports 111. In the embodiments, for simplicity, the side supports located on both sides are described as "left support" and "right support".

Still referring to FIG. 2, each of the side supports 111 may include a plurality of first support rods 1101 and at least two second support rods 1102.

The second support rods 1102 each have a rod-shaped structure extending in a height direction of the foldable shelf. The two second support rods 1102 are parallel to each other to form a frame in the height direction.

The first support rods 1101 each are arranged in a horizontal direction, and two ends thereof are fixed between rod bodies of at least two support rods 1102. Different first support rods 1101 are also substantially parallel to each other and arranged at a certain height distance h to form a supporting structure for supporting the layer plates 200.

In some embodiments, one or more components of the support structure 110 may be further adjusted, replaced, added or omitted. For example, as shown in FIG. 1, one or more other structural components may be added to the support structure 110 to further facilitate daily use or operation.

Figure 4:
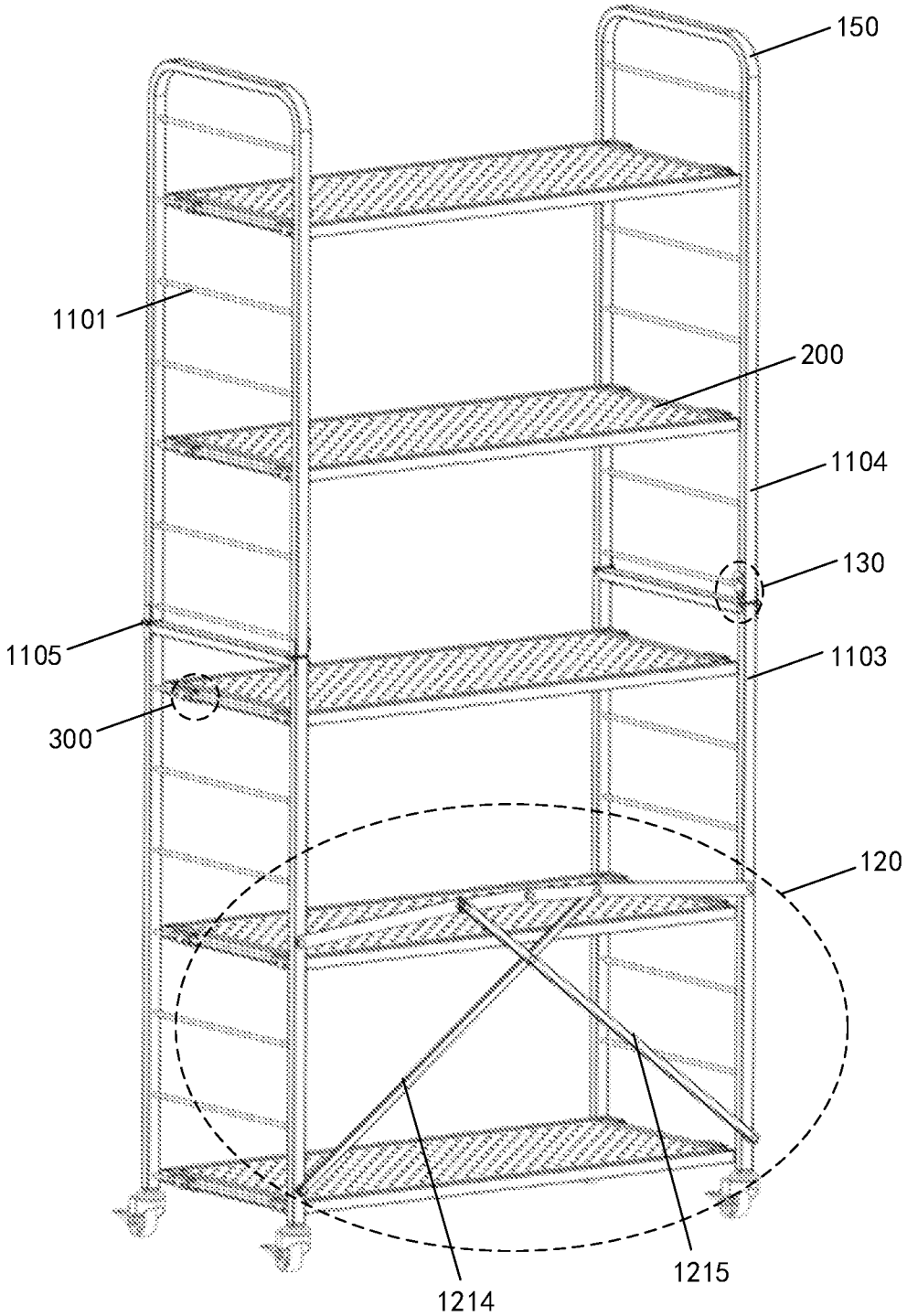
FIG. 4 is a schematic structural diagram illustrating a foldable shelf in an unfolded state according to another embodiment of the present disclosure.

For example, a roller 140 (such as a universal wheel) may be further arranged at the bottom of the support structure 110 to facilitate movement of the foldable shelf. Or, as shown in FIG. 4, a top 150 with a certain radian is arranged at a top end of the side support 111 to facilitate force application by a user to the foldable shelf or achieve other effects.

The folding mechanism 120 is an action mechanism connected between the left support 111*a* and the right support 111*b*. The folding mechanism 120 has a deformation capability, and can drive the left support and the right support to approach each other or stay away from each other, such that the support body 110 can switch between the unfolded state and the folded state.

The folding mechanism 120 may specifically be any suitable type of action mechanism, such as a diamond-shaped folding mechanism shown in FIG. 1. As shown in FIG. 1, a main body of the diamond-shaped folding mechanism is a link mechanism k composed of an upper left connecting rod 1201, a lower left connecting rod 1202, an upper right connecting rod 1203, and a lower right connecting rod 1204. Two ends of each connecting rod in the linkage mechanism are hinged separately to form four joints (an upper joint 1205, a lower joint 1206, a left joint 1207, and a right joint 1208).

The upper joint 1205 may slide back and forth in a vertical direction along a strip-shaped chute 1210 provided with a linkage vertical rod 1209, and the lower joint 1206 is fixed at the bottom of the linkage vertical rod 1209.

The left joint 1207 and the right joint 1208 are respectively hinged to the left support 111*a* and the right support 111*b* through a left support rod 1211 and a right support rod 1212 that each have a certain length, respectively.

Therefore, by moving the upper joint 1205 up and down, an angle between the four connecting rods in the diamond-shaped folding mechanism may be changed, such that the left support and the right support can be driven to approach each other or stay away from each other.

Certainly, based on a folding principle of the folding mechanism disclosed in FIG. 1, a person skilled in the art may further add, remove, adjust, or replace one or more components of the folding mechanism to obtain more other embodiments.

For example, as shown in FIG. 2, a supporting rod 1213 hinged between the linkage vertical rod and the side support may be added to the linkage mechanism, for achieving the similar effect to the folding mechanism shown in FIG. 1. Alternatively, as shown in FIG. 4, the linkage vertical rod 1209 can be omitted, and the left support rod and the right support rod are adjusted into an integrated design with the left lower connecting rod and the right lower connecting rod, respectively, such that a left connecting rod 1214 and a right connecting rod 1215 that cannot be bent are formed.

The layer plates 200 are a plate-like structure arranged or erected between the two side supports of the support body 100. In the unfolded state, a plurality of layer plates 200 mounted and fixed on the support body 110 may form multiple layers of storage spaces C at intervals for storing or placing objects.

In one aspect, the number of the layer plates 200 may be provided based on actual needs (such as a height of the side support). For example, as shown in FIG. 1 and FIG. 2, five layer plates 200 may be provided, and are distributed at different heights at the same interval.

In another aspect, any suitable type of connection method or connection structure may be adopted between the support body 100 or the side support 111 and the layer plates 200, so that the support body 100 has a different shape when switched to the folded state. For example, as shown in FIG. 2, a detachable connection method may be adopted between the support body 100 and the layer plates 200. In this way, in the folded state, the layer plates 200 are detached from the support body 100 and separated from the support body 100.

It should be noted that, the plurality of layer plates 200 shown in FIG. 2 are only for illustration, which do not limit a method for specific placement of the layer plates 200. Each of the layer plates 200 is an independent component, and an appropriate placement or stacking method may be selected as required, and is not limited to that shown in FIG. 2.

In alternative embodiment, the layer plates 200 may alternatively be connected to one of the side supports through a rotating shaft, and connected to the other side support in a detachable manner. In this way, in the folded state, the layer plates 200 are separated from one of the side supports and stacked with the other side support by rotation.

Certainly, other suitable structures may also be added to the layer plates 200 to achieve richer functions. For example, as shown in FIG. 1 and FIG. 2, a plurality of holes may be further formed in the layer plates 200 to provide a function of water draining and the like.

The fixing mechanism 300 is a buckle type fixing apparatus, and is configured to fix the layer plates 200 on the support body 100 in the unfolded state, such that the structural strength of the foldable shelf can be improved.

Figure 3:
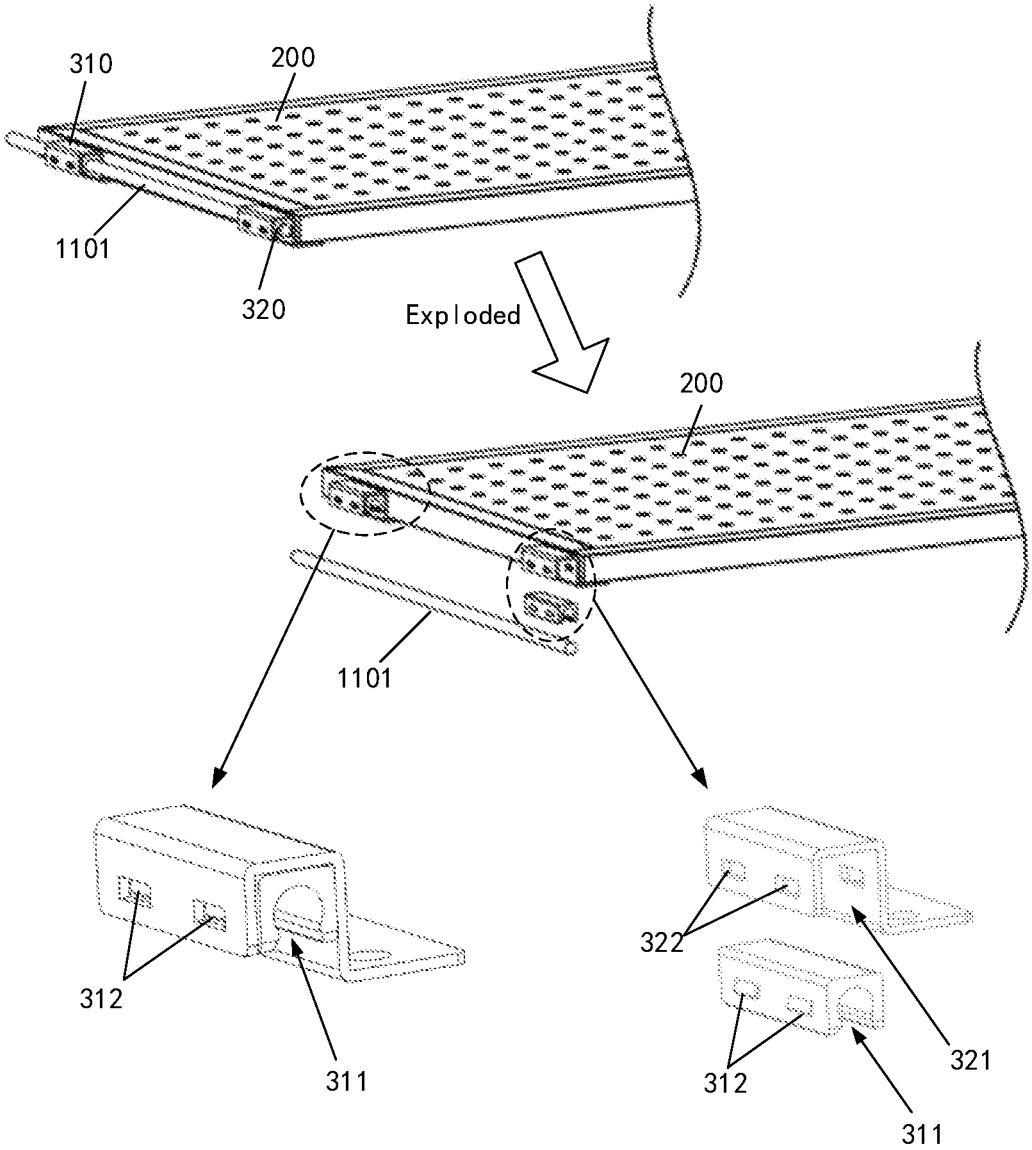
FIG. 3 is a schematic structural diagram illustrating a fixing mechanism according to an embodiment of the present disclosure.

FIG. 3 is a schematic structural diagram illustrating the fixing mechanism 300 according to an embodiment of the present disclosure. As shown in FIG. 3, the fixing mechanism 300 includes a first fastener 310 and a second fastener 320 that cooperate with each other for use.

An outer surface of the first fastener 310 is provided with at least one protrusion 312, which is used as an outwardly-protruding male fastener of a buckle. Specifically, the protrusion 312 may also be provided with an inclined plane serving as a guide angle or a similar inclined structure, which guides a buckling direction between the first fastener 310 and the second fastener 320.

The second fastener 320 is provided with a groove 321 for accommodating the first fastener, and a side wall of the groove 321 is provided with a through hole 322. The through hole 322 fits with the protrusion 312, has the same quantity as the protrusion 312 and a corresponding size, and is used as a female fastener.

In some embodiments, as shown in FIG. 3, the first fastener 310 may be arranged on the support body 100, and snap-fit and fixed to the first support rod 1101 through an arc-shaped groove 311 running through the first fastener 310. The second fastener 320 is arranged on the layer plate 200 and formed by extending outward from an edge of the layer plate.

Certainly, based on a buckle type fixing principle the same as that described above, positions of the first fastener 310 and the second fastener 320 or one or more relative structures thereof may be exchanged correspondingly in other embodiments.

Figure 5:
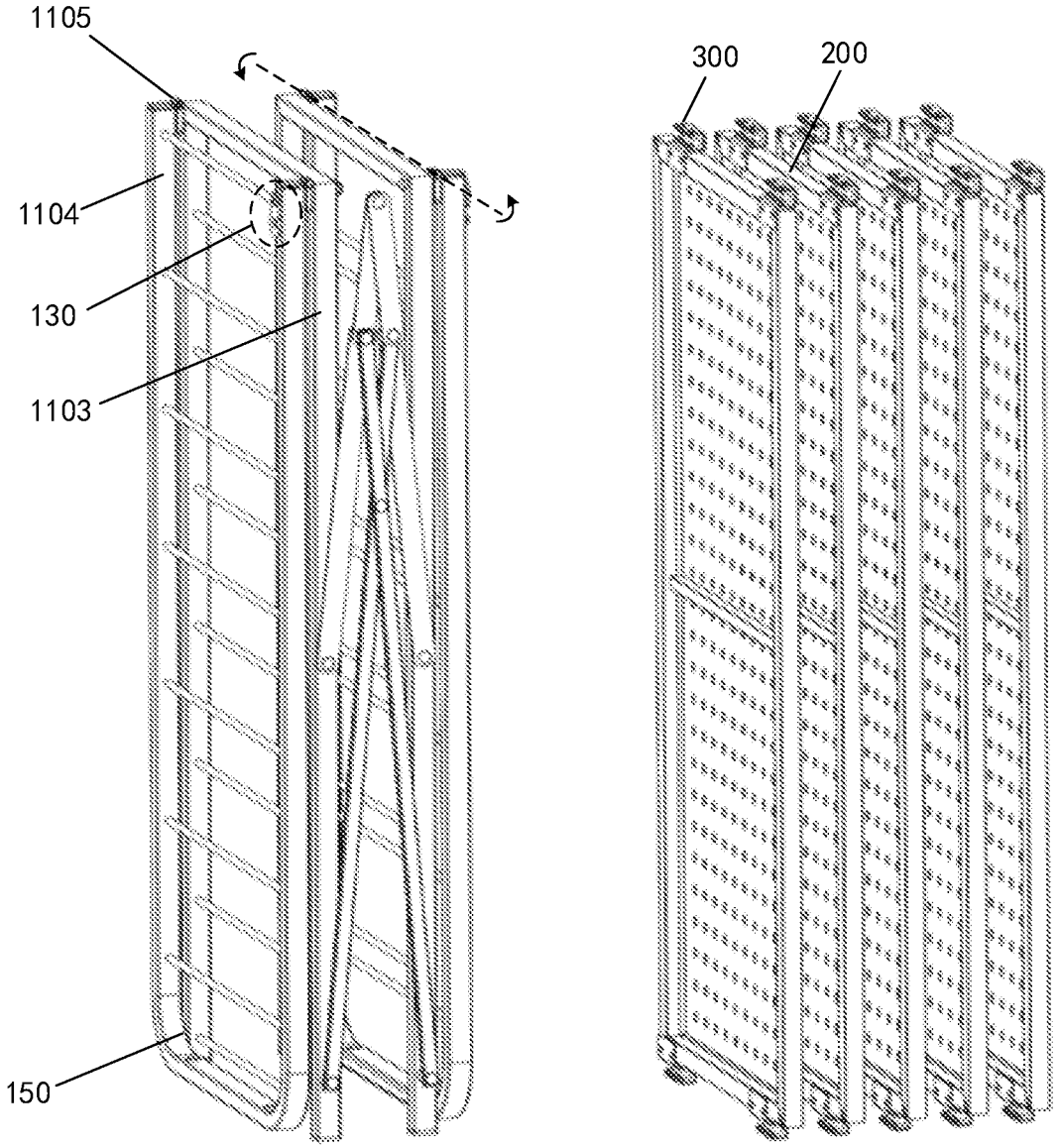
FIG. 5 is a schematic structural diagram illustrating a foldable shelf in a secondary folded state according to another embodiment of the present disclosure.

FIG. 4 is a schematic structural diagram illustrating a foldable shelf in a folded state according to another embodiment of the present disclosure. FIG. 5 is a schematic structural diagram illustrating a foldable shelf in a secondary folded state according to another embodiment of the present disclosure.

In this embodiment, "secondary folding" refers to folding the support body in the height direction on the basis of the folded state (i.e., the two side supports approach each other) in the horizontal direction, such that the volume occupied by the foldable shelf (mainly to reduce the height of the side support) can be further reduced.

As shown in FIG. 4 and FIG. 5, the second support rod 1102 of the side support includes a base rod 1103 and an overturning rod 1104.

The base rod 1103 is a rod body part extending upward from a bottom end by a preset first length, which is a relatively fixed part and does not rotate.

The remaining part of the second support rod 1102 may be the overturning rod 1104 with a second length. The overturning rod 1104 is hinged to the base rod 1103, and is capable of rotating around a hinge shaft 1105 between the overturning rod 1104 and the base rod 1103 by taking the base rod 1103 as a base.

As the overturning rod 1104 rotates to a position overlapping with the base rod 1103, the height of the side support may be further reduced, so that the foldable shelf is switched from the folded state to the secondary folded state.

Specifically, the first length and the second length are empirical values, which may be set by a skilled person based on actual needs. The first length and the second length reflect a ratio of the length of the base rod 1103 to the length of the overturning rod 1104 in the second support rod. For example, the base rod 1103 and the overturning rod 1104 may be provided with the same length.

In some embodiments, the rotatable second support rod 1102 may accidentally rotate during folding or unfolding, causing damage or injury to a user. Therefore, as shown in FIG. 4 and FIG. 5, an additional rotation limiting mechanism 130 may be further added to the support body 100.

The rotation limiting mechanism 130 is arranged on at least one of the second support rods 1102. For avoiding adverse impact caused by accidental rotation, the rotation limiting mechanism 130 can be configured to lock the overturning rod 1104 and limit the rotation of the overturning rod 1104 relative to the base rod 1103 during the needed time.

Figure 6:
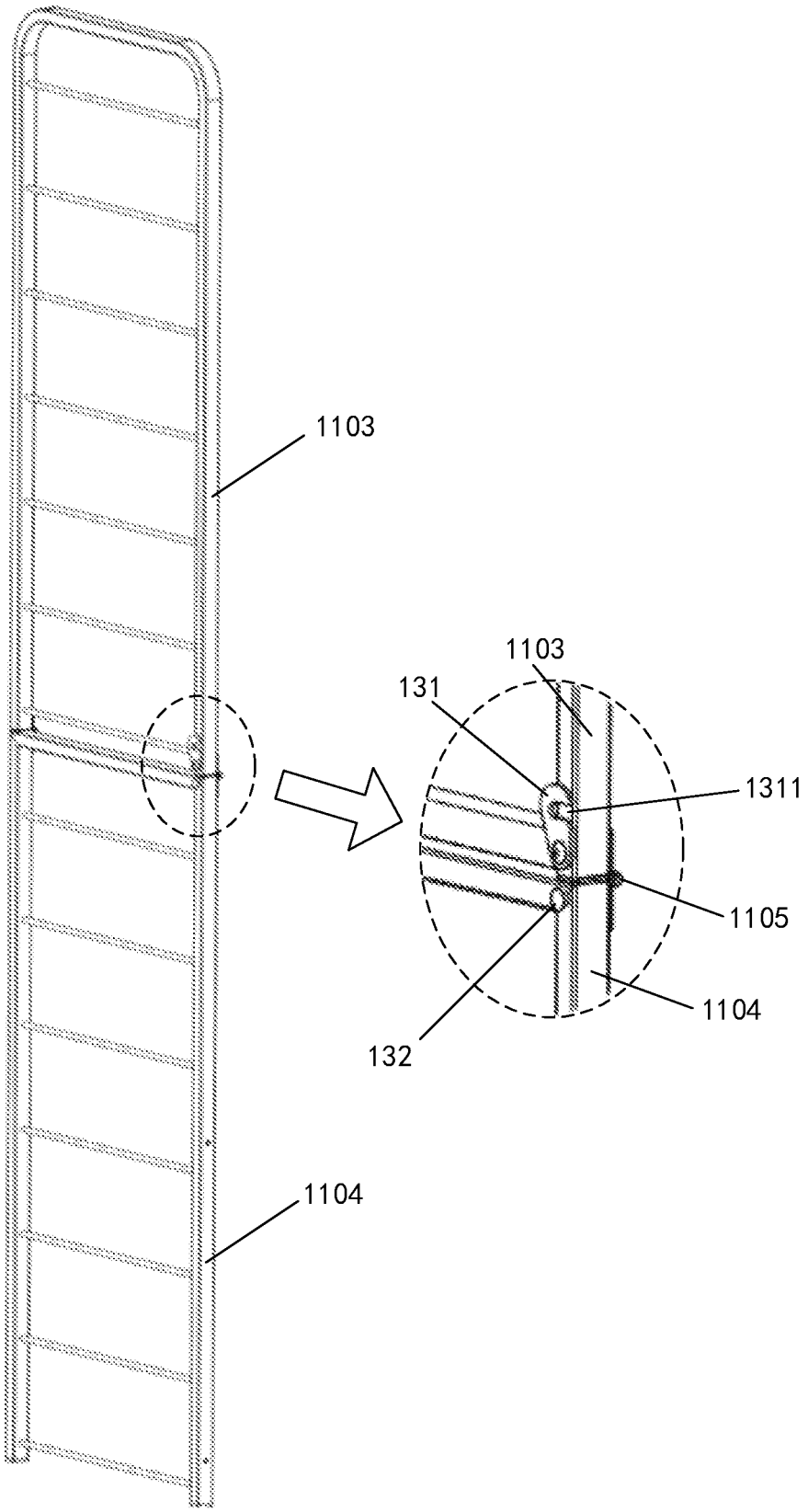
FIG. 6 is a schematic structural diagram illustrating a rotation limiting mechanism according to an embodiment of the present disclosure.
Figure 7:
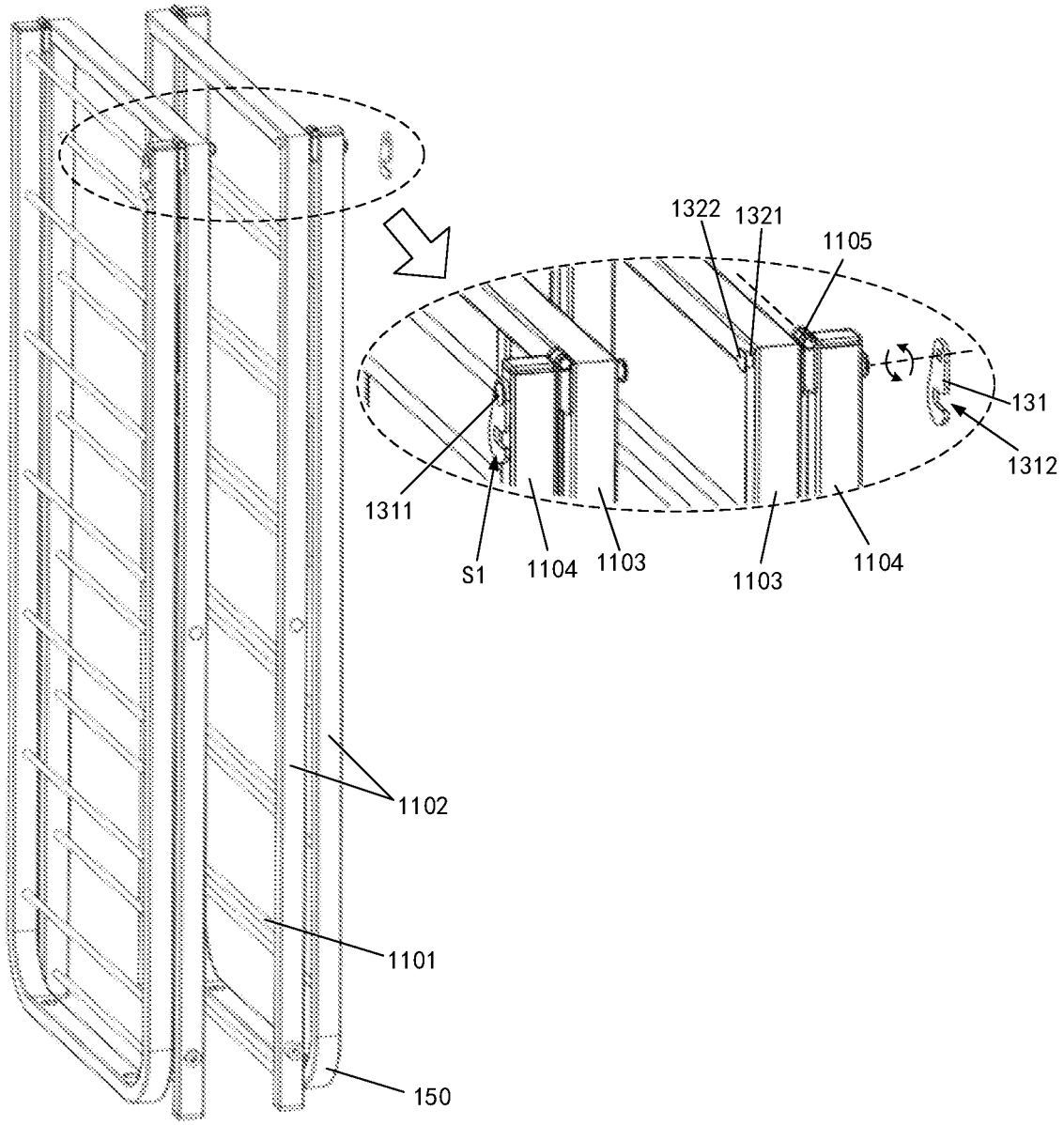
FIG. 7 is a schematic diagram illustrating a breakdown structure of a rotation limiting mechanism according to an embodiment of the present disclosure.

FIG. 6 is a schematic structural diagram illustrating a rotation limiting mechanism 130 according to an embodiment of the present disclosure. As shown in FIG. 7, the rotation limiting mechanism 130 may include a rotating fastener 131 and a limiting member 132.

One side of the rotating fastener 131 is provided with a notch 1311, and is capable of rotating around a rotation axis parallel to a first plane. Specifically, the first plane is a plane perpendicular to the hinge shaft 1105.

The limiting member 132 has a limiting structure matching the notch. The limiting member 132 protrudes from the second support rod 1102 and can be accommodated in the notch 1312 with the rotation of the rotating fastener 131. Specifically, a dovetail or another similar snap-fit structure may be provided between the notch 1312 and the limiting member 132 to prevent the limiting member 132 from being easily separated from the notch 1312.

Like the fixing mechanism provided in the foregoing embodiment, the rotating fastener 131 and the limiting member 132 are arranged on the overturning rod 1104 and the base rod 1103 respectively. Therefore, when the rotating fastener 131 rotates and is snap-fit to the limiting member 132 (i.e., the limiting member 132 is accommodated in the notch 1312), the rotation of the overturning rod 1104 may be limited.

It should be noted that, although in the embodiment shown in FIG. 6, descriptions are made by taking an example in which the rotating fastener 131 is arranged on the overturning rod 1104 and the limiting member 132 is arranged on the base rod 1103, a person skilled in the art may interchange the arrangement positions of the two in other embodiments.

Figure 8:
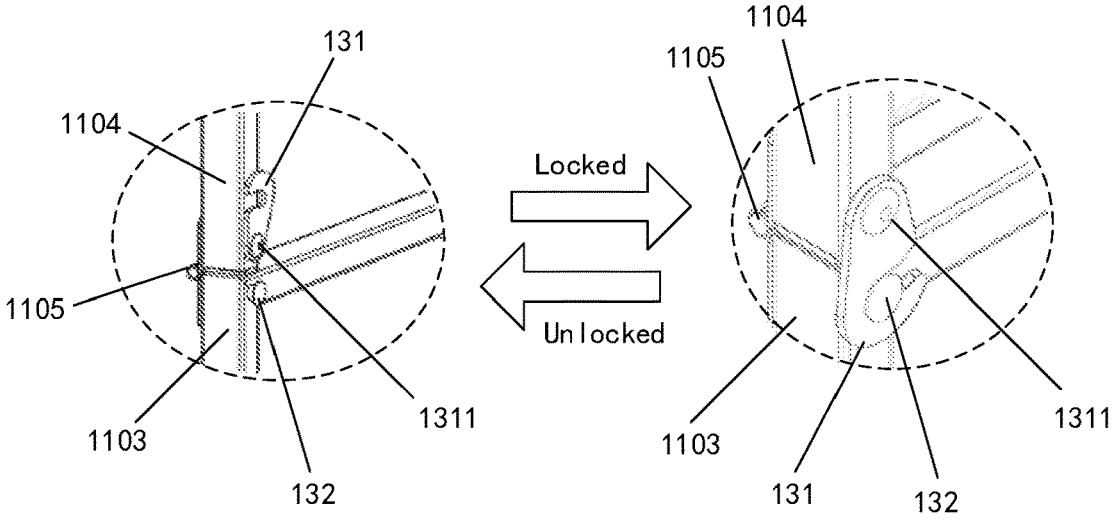
FIG. 8 is a schematic structural diagram illustrating a locking action of a rotation limiting mechanism according to an embodiment of the present disclosure.

In some embodiments, as shown in FIG. 7 and FIG. 8, the rotating fastener 131 is a plate-shaped component with a specific area, which extends from the overturning rod 1104 to a position in which the base rod 1103 is located.

The rotating fastener 131 may be hinged to the second support rod 1102 via a rotating shaft 1311. The rotating shaft 1311 and the hinge shaft 1105 have a mutually perpendicular positional relationship, which enables the rotating fastener 131 to rotate on a surface of the second support rod.

In this embodiment, for simplicity of description, a surface of the rotating fastener 131 that faces away from the second support rod 1102 is defined as an upper surface 51, and a surface of the rotating fastener 131 that is opposite to the second support rod 1102 is defined as a lower surface.

Still referring to FIG. 7 and FIG. 8, the limiting member 132 may include a limiting column 1321 and a column cap 1322.

The limiting column 1321 has a preset third length from the surface of the second support rod. The third length is a length matching a thickness of the rotating fastener 131. The column cap 1322 is a swelled part located at an end of the limiting column. The column cap 1322 extends outward and forms a stepped surface with the limiting column.

Thus, when the limiting member 132 is accommodated in the notch 1312 of the rotating fastener, the column cap 1322 abuts against the upper surface 51 of the rotating fastener that faces away from the second support rod, to limit overturning of the overturning rod 1104.

A process of actual use of the foldable shelf is described in detail below with reference to FIG. 1 to FIG. 8. It can be understood that, the technical features (such as the fixing mechanism, the rotation limiting mechanism, and the overturning rod) provided by the above embodiments may be combined or one or more thereof may be selectively used in other embodiments, so that the foldable shelf has the advantages of the technical features.

In one aspect, during the switching from the folded state to the unfolded state, a diamond-shaped telescopic frame may first be pressed down (i.e., the upper joint 1206 is enabled to slide downward). In this case, the left support rod 1211 correspondingly straightens the upper left connecting rod 1201 and the lower left connecting rod 1202, and the right support rod 1212 correspondingly straightens the upper right connecting rod 1203 and the lower right connecting rod 1204 to make the left support 111*a* and the right support 111*b* stay away from each other, so that the support body 100 is in the unfolded state.

Then, the second fasteners 320 separately arranged on two sides of the layer plates 200 that are connected to the left support 111*a* and the right support 111*b* are respectively in buckled connections with the first fasteners 310 on the left support 111*a* and the right support 111*b*, so that the layer plates 200 are fixedly mounted on the support body 100 in the unfolded state.

During the switching from the unfolded state to the folded state, the layer plates 200 are first detached from the support body 100. Then, the diamond-shaped telescopic frame may be lifted up (i.e., the upper joint 1206 is enabled to slide upward). In this case, the left support rod 1211 correspondingly bends and retracts the upper left connecting rod 1201 and the lower left connecting rod 1202, and the right support rod 1212 correspondingly bends and retracts the upper right connecting rod 1203 and the lower right connecting rod 1204 to make the left support 111*a* and the right support 111*b* approach each other, so that the support body 100 is restored to the folded state.

The fixing mechanism based on the buckled connections enables the layer plates 200 to be easily detached from and mounted on the support body 100 without using additional tools.

In addition, the fixing mechanism is separately arranged on the layer plates 200 and the support body 100, without requiring additional assembling parts, which is beneficial to avoiding inconvenience caused by loss of parts.

In another aspect, during the switching from the folded state to the secondary folding, the rotating fastener 131 is first rotated to be separated from the limiting member 132, so that the rotation limiting mechanism 130 unlocks the overturning rod 1104.

Then, the overturning rod 1104 is rotated, so that it rotates around the hinge shaft 1105 to a position overlapping the base rod 1103. As such, a height of the second support rod 1102 is effectively reduced, and the secondary folding of the support body 100 is implemented.

During the switching from the folded state to the secondary folded state, the overturning rod 1104 is first rotated, so that it reversely rotates around the hinge shaft 1105 to a position opposite to the base rod 1103 (i.e., an end of the overturning rod 1104 is connected to the top of the base rod 1103), and the second support rod 1102 is restored to its original height.

Then, the rotating fastener 131 is rotated, so that the limiting member 132 enters and is accommodated in the notch 1312 of the rotating fastener 131. The limiting member 132 snap-fit to the notch 1312 and the rotating fastener 131 abut against each other to lock the overturning rod 1104 and limit the rotation of the overturning rod 1104.

Based on the folded state, secondary folding may be performed on the second support rod that is designed with a two-stage hinged structure of the overturning rod and the base rod, and this is beneficial to reducing the volume occupied by the foldable shelf. Moreover, in conjunction with the rotation limiting mechanism 130, a locked state of the second support rod can be maintained when the second support rod is not needed to fold, for the purpose of avoiding adverse impact (such as injury to a user caused by accidental rotation) caused by a rotary motion of the overturning rod 1104.

Figure 9:
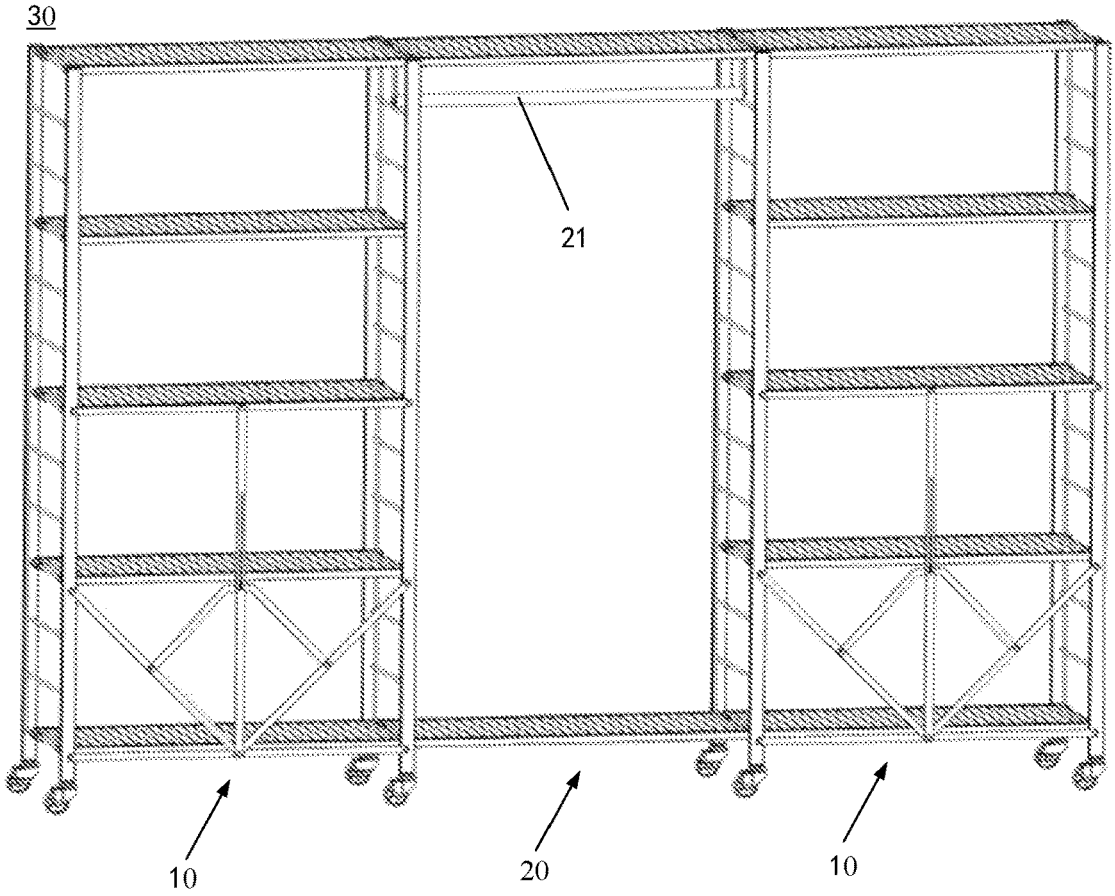
FIG. 9 is a schematic structural diagram illustrating a combined shelf according to an embodiment of the present disclosure.

Based on the foldable shelf provided in the embodiments of the present disclosure, the present disclosure further provides a combined shelf, which can be used in a variety of different scenarios and has rich usages. FIG. 9 is a schematic structural diagram of a combined shelf according to an embodiment of the present disclosure.

As shown in FIG. 9, the combined shelf is composed of two foldable shelves 10 and a lap joint support 20.

The lap joint support 20 is located between the two foldable shelves 10, and is combined with the foldable shelves 10 in a detachable connection manner (such as a buckled connection) to form a complete shelf.

In some embodiments, additional functional structures may be added to the lap joint support 20 to enrich functions of the shelf. For example, as shown in FIG. 9, a cross rod 21 may be added to the lap joint support 20 to hang clothes, towels or other larger-area fabrics (such as bed sheets, bedding, or curtains) and the like.

Based on a rich storage space and functional areas provided by the combined shelf 30, the combined shelf 30 may be placed in various scenes to meet actual needs. For example, the combined shelf 30 may be placed in a living room as a commonly used shelf, or the combined shelf 30 may be placed in a bedroom as a wardrobe for placing clothes, or may be placed in a kitchen to place seasonings, food or other kitchen utensils.

Further, the combined shelf 30 may be placed on a balcony as a washing machine rack or placed in a bathroom as a toilet rack.

It should be noted that, preferred embodiments of the present disclosure are given in the specification and accompanying drawings of the present disclosure. However, the present disclosure may be implemented in many different forms, which are not limited to the embodiments described in the specification. These embodiments are not taken as additional limitations on the content of the present disclosure. The purpose of providing these embodiments is to enable more thorough and comprehensive understanding of the disclosure of the present disclosure. In addition, the above technical features may be further combined with each other to form various embodiments not listed above, which are regarded as falling within the scope described in the specification of the present disclosure. Further, for a person of ordinary skill in the art, improvements or transformations may be made according to the above description, and all these improvements and transformations shall fall within the protection scope of the appended claims of the present disclosure.

What is claimed is:

1. A foldable shelf (10), comprising:

a foldable support body (100) that is capable of being switched between a folded state and an unfolded state; wherein the support body (100) comprises a pair of side supports (111);

several layer plates (200), wherein the several layer plates (200) fit with the support body (100) to form a storage space (C) in the unfolded state and reduce a volume of the foldable shelf (10) in the folded state; and a fixing mechanism (300) for securing the layer plates (200) to the support body (100), wherein the fixing mechanism (300) comprises:

a first fastener (310), wherein an outer surface of the first fastener (310) is provided with at least one protrusion (3112); and a second fastener (320) provided with a groove (3211) for accommodating the first fastener (310); wherein a side wall of the groove (3211) is provided with a through hole (3212) matching the protrusion (3112);

wherein the side supports (111) each comprise:

at least one first support rod (1101) configured to support the layer plates (200); and several second support rods (1102) extending in a height direction of the foldable shelf (10), wherein two ends of the first support rod (1101) are fixedly connected between rod bodies of at least two of the second support rods (1102);

wherein the second support rods (1102) each comprise:

a base rod (1103) extended upward from a bottom end of the second support rod (1102) by a preset first length; and an overturning rod (1104) with a preset second length, wherein the overturning rod (1104) is hinged to the base rod (1103) and is capable of rotating around the base rod (1103) relative to a hinge shaft (1105), so that the foldable shelf (10) is capable of being switched between the folded state and a secondary folded state.

2. The foldable shelf according to claim 1, wherein the support body (100) further comprises:

a folding mechanism (120) arranged between the paired side supports (111), wherein the folding mechanism (120) guides the paired side supports (111) to stay away from each other, so that the support body (100) is switched from the folded state to the unfolded state; and the folding mechanism (120) guides the paired side supports (111) to approach each other, so that the support body (110) is switched from the unfolded state to the folded state.

3. The foldable shelf according to claim 1, wherein the first fastener (310) is provided with an arc-shaped groove (311) running through the first fastener (310);

the arc-shaped groove (311) matches the first support rod (1101), so that the first fastener (310) is snap-fit and fixed to the first support rod (1101); and the second fastener (320) is formed by extending outward from an edge of the layer plate (200).

4. The foldable shelf according to claim 1, wherein the layer plates (200) are fixedly mounted between the paired side supports (111) in the unfolded state, and the layer plates (200) are detached from the paired side supports (111) in the folded state.

5. The foldable shelf according to claim 1, wherein the support body further comprises: a rotation limiting mechanism (130) arranged on at least one of the second support rods (1102) for limiting the rotation of the overturning rod (1104) relative to the base rod (1103).

6. The foldable shelf according to claim 5, wherein the rotation limiting mechanism (130) comprises:

a rotating fastener (131) with one side provided with a notch (1311), wherein the rotating fastener (131) is capable of rotating around a rotation axis (1312) parallel to a first plane; and the first plane is a plane perpendicular to the hinge shaft (1105); and a limiting member (132) being matched with the notch (1311) and accommodated in the notch (131) with the rotation of the rotating fastener (131), wherein the rotating fastener (131) and the limiting member (132) are arranged on the overturning rod (1104) and the base rod (1103) respectively, so that when the limiting member (132) is accommodated in the notch (1311), the rotation of the overturning rod (1104) is limited.

7. The foldable shelf according to claim 6, wherein the limiting member (132) comprises:

a limiting column (1321) with a preset third length; and a column cap (1322) located at an end of the limiting column, wherein the column cap (1322) abuts against an upper surface (51) of the rotating fastener (131) when the limiting member (132) is accommodated in the notch (1311) of the rotating fastener (131); and the upper surface (51) is a surface of the rotating fastener (131) that faces away from the second support rod (1102).

8. A combined shelf (30), comprising at least one foldable shelf (10) and a lap joint support (20) detachably connected to the foldable shelf (10), wherein the lap joint support (20) is in lap joint with one foldable shelf (10) or between a plurality of foldable shelves (10);

wherein the foldable shelf comprises:

a foldable support body (100) that is capable of being switched between a folded state and an unfolded state;

several layer plates (200), wherein the several layer plates (200) fit with the support body (100) to form a storage space (C) in the unfolded state and reduce a volume of the foldable shelf (10) in the folded state; and a fixing mechanism (300) for securing the layer plates (200) to the support body (100), wherein the fixing mechanism (300) comprises:

a first fastener (310), wherein an outer surface of the first fastener (310) is provided with at least one protrusion (3112); and a second fastener (320) provided with a groove (3211) for accommodating the first fastener (310); wherein a side wall of the groove (3211) is provided with a through hole (3212) matching the protrusion (3112);

wherein the side supports (111) each comprise:

at least one first support rod (1101) configured to support the layer plates (200); and several second support rods (1102) extending in a height direction of the foldable shelf (10), wherein two ends of the first support rod (1101) are fixedly connected between rod bodies of at least two of the second support rods (1102);

wherein the second support rods (1102) each comprise:

a base rod (1103) extended upward from a bottom end of the second support rod (1102) by a preset first length; and an overturning rod (1104) with a preset second length, wherein the overturning rod (1104) is hinged to the base rod (1103) and is capable of rotating around the base rod (1103) relative to a hinge shaft (1105), so that the foldable shelf (10) is capable of being switched between the folded state and a secondary folded state.

9. The combined shelf (30) according to claim 8, wherein the lap joint support (20) further comprises a cross rod (21).

10. The combined shelf (30) according to claim 8, wherein the support body (100) comprises:

a folding mechanism (120) arranged between the paired side supports (111), wherein the folding mechanism (120) guides the paired side supports (111) to stay away from each other, so that the support body (100) is switched from the folded state to the unfolded state; and the folding mechanism (120) guides the paired side supports (111) to approach each other, so that the support body (110) is switched from the unfolded state to the folded state.

11. The combined shelf (30) according to claim 8, wherein the first fastener (310) is provided with an arc-shaped groove (311) running through the first fastener (310);

the arc-shaped groove (311) matches the first support rod (1101), so that the first fastener (310) is snap-fit and fixed to the first support rod (1101); and the second fastener (320) is formed by extending outward from an edge of the layer plate (200).

12. The combined shelf (30) according to claim 8, wherein the layer plates (200) are fixedly mounted between the paired side supports (111) in the unfolded state, and the layer plates (200) are detached from the paired side supports (111) in the folded state.

13. The combined shelf (30) according to claim 8, wherein the support body further comprises: a rotation limiting mechanism (130) arranged on at least one of the second support rods (1102) for limiting the rotation of the overturning rod (1104) relative to the base rod (1103).

14. The combined shelf (30) according to claim 13, wherein the rotation limiting mechanism (130) comprises:

a rotating fastener (131) with one side provided with a notch (1311), wherein the rotating fastener (131) is capable of rotating around a rotation axis (1312) parallel to a first plane; and the first plane is a plane perpendicular to the hinge shaft (1105); and a limiting member (132) being matched with the notch (1311) and accommodated in the notch (131) with the rotation of the rotating fastener (131), wherein the rotating fastener (131) and the limiting member (132) are arranged on the overturning rod (1104) and the base rod (1103) respectively, so that when the limiting member (132) is accommodated in the notch (1311), the rotation of the overturning rod (1104) is limited.

15. The combined shelf (30) according to claim 14, wherein the limiting member (132) comprises:

a limiting column (1321) with a preset third length; and a column cap (1322) located at an end of the limiting column, wherein the column cap (1322) abuts against an upper surface (51) of the rotating fastener (131) when the limiting member (132) is accommodated in the notch (1311) of the rotating fastener (131); and the upper surface (51) is a surface of the rotating fastener (131) that faces away from the second support rod (1102).

* * * * *